US006391505B1

(12) United States Patent
Hamasaki et al.

(10) Patent No.: US 6,391,505 B1
(45) Date of Patent: May 21, 2002

(54) PHTHALOCYANINE CRYSTAL AND ITS PRODUCTION, AND ELECTROPHOTOSENSITIVE MATERIAL USING THE SAME

(75) Inventors: Kazunari Hamasaki; Yukimasa Watanabe, both of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/627,001

(22) Filed: Jul. 27, 2000

(30) Foreign Application Priority Data

Jul. 28, 1999 (JP) ..... 11-213814

(51) Int. Cl.[7] ..... G03G 5/06

(52) U.S. Cl. ..... 430/59.4; 430/78; 430/83; 430/135; 540/122; 540/123; 540/128; 540/130; 540/139; 540/140; 540/141

(58) Field of Search ..... 430/78, 135, 83, 430/59.5, 59.4; 540/139, 140, 141, 122, 123, 130, 128; 252/501.1; 106/410

(56) References Cited

U.S. PATENT DOCUMENTS 5,443,935 A * 8/1995 Kojima et al. ..... 430/78
6,268,097 B1 * 7/2001 Hayata et al. ..... 430/78

FOREIGN PATENT DOCUMENTS

JP 05-333575 A * 12/1993 ..... 430/83
JP 6-123984 5/1994
JP 07-005715 A * 1/1995 ..... 430/56
JP 7-104495 4/1995

* cited by examiner

*Primary Examiner*—Christopher Rodee
(74) *Attorney, Agent, or Firm*—Smith, Gambrell & Russell, LLP

(57) ABSTRACT

Disclosed are a phthalocyanine crystal in which an organic acceptor compound is associated with a phthalocyanine molecule, wherein said organic acceptor compound has a reduction potential to a reference electrode ($Ag^+/Ag$) is not less than −1.5 V and not more than −0.5 V, and an electrophotosensitive material containing said phthalocyanine crystal as an electric charge generating material, which exhibits sufficient photosensitivity even in high-speed image forming apparatuses.

24 Claims, 2 Drawing Sheets

PHTHALOCYANINE CRYSTAL AND ITS PRODUCTION, AND ELECTROPHOTOSENSITIVE MATERIAL USING THE SAME

BACKGROUND OF THE INVENTION

The present invention relates to a phthalocyanine crystal associating with an organic acceptor compound, its production method, and a high-sensitivity electrophotosensitive material containing the same.

With the development of a non-impact printer technique, an electrographic photoprinter using laser beam or LED as a light source,which is capable of attaining high image quality and high speed, has widely been used and a photosensitive material which responds to the demands has intensively been developed, recently. Among these photosensitive materials, an organic photosensitive material has widely been used because of its easy production, wide range of choice of photosensitive materials and high functional design freedom as compared with a conventional inorganic photosensitive material.

The organic photosensitive material includes, for example, single-layer type photosensitive material wherein an electric charge transferring material is dispersed in the same photosensitive layer, together with an electric charge transferring material, and function-separation type multi-layer type photosensitive material comprising an electric charge generating layer containing an electric charge generating material and an electric charge transferring layer containing an electric charge transferring material, which are mutually laminated.

When using a laser as a light source, a semiconductor laser is exclusively used because of its small size, cheap price, and simplicity. The oscillation wavelength of the semiconductor laser is not less than 750 nm at present and is limited to an infrared range. Accordingly, an organic photosensitive material having the sensitivity at a wavelength within a range from 750 to 850 nm is required.

As the electric charge generating material used in the organic photosensitive material, which satisfies the above demands, for example, polycyclic quinone pigment, pyrylium dye, squarium pigment, phthalocyanine pigment, and azo pigment have been suggested or put into practice.

Among the above electric charge generating materials, most popular phthalocyanine pigments include, for example, metal-free phthalocyanine having no center metal and metallic phthalocyanine having a center metal, and they have various crystal forms such as α, β, and γ forms. The presence or absence and kind of the center metal as well as crystal form exert a large influence on the charging properties and sensitivity of the photosensitive material.

As the method of attaining a high-sensitivity photosensitive material using phthalocyanine, for example, a method of adding an organic acceptor compound in a photosensitive material has been studied. Japanese Unexamined Patent Publication (Kokai) No. 7-104495 describes a method of adding an organic acceptor compound in an electric charge generating layer of a multi-layer photosensitive material, while Japanese Unexamined Patent Publication (Kokai) No. 6-123984 describes a method of adding an organic acceptor compound in a binder of a single-layer photosensitive material.

However, any of the above methods is a method of adding an organic acceptor compound in the production process of a photosensitive material, that is, a method of adding an organic acceptor compound in the production process of a coating solution for photosensitive layer. A high-speed image forming apparatus has such a problem that the photosensitivity of its photosensitive material is poor, and a further improvement in photosensitivity is required.

SUMMARY OF THE INVENTION

Thus, an object of the present invention is to provide a novel phthalocyanine crystal useful as an electric charge generating material, and a production method thereof.

Another object of the present invention is to provide an extra-high-sensitivity electrophotosensitive material containing the above phthalocyanine crystal.

The present inventors have intensively studied to attain the above object and found that a photosensitive material containing, as an electric charge generating material, a phthalocyanine crystal produced by adding an organic acceptor compound in a photosensitive layer during the step of converting into a pigment, not produced by merely adding the organic acceptor in the photosensitive layer.

Thus, the present inventions relate to:

1. A phthalocyanine crystal in which an organic acceptor compound whose reduction potential to a reference electrode ($Ag^+/Ag$) is not less than −1.5 V and not more than −0.5 V is associated with a phthalocyanine molecule.
2. The phthalocyanine crystal according to the above item 1, wherein said phthalocyanine is a metal-free phthalocyanine.
3. The phthalocyanine crystal according to the above item 1, wherein said phthalocyanine is a metal phthalocyanine represented by the general formula (1):

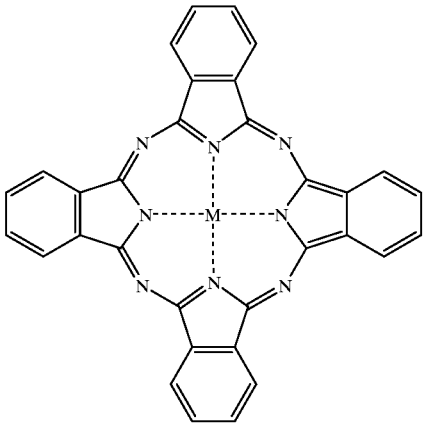

wherein M is a metal of the groups IIa, IIIa, IVa, Va, VII, Ib, IIb, IIIb, IVb or VIb on the periodic table, or a group containing the metal.

4. The phthalocyanine crystal according to the above item 3, wherein the group containing the metal is in the form of oxide, hydroxide, halide or cyanide.
5. The phthalocyanine crystal according to the above item 3, wherein M is TiO.
6. The phthalocyanine crystal according to the above item 1, wherein a solubility of said organic acceptor compound in a solvent in a coating solution for photosensitive layer is less than 10% by weight.
7. The phthalocyanine crystal according to the above item 6, wherein said solvent in a coating solution for photosensitive layer is alcohols, ketones or ethers.

8. The phthalocyanine crystal according to the above item 1, wherein said organic acceptor compound contains a compound represented by the general formula (2):

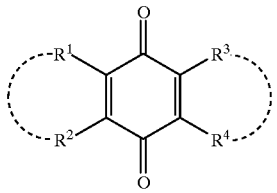

wherein $R^1$, $R^2$, $R^3$ and $R^4$ are the same or different and each represents a hydrogen atom, a halogen atom, or an alkyl, alkyl halide, alkoxy, aryl, aralkyl, cycloalkyl, cyano, nitro or amino group which may have a substituent, with a proviso that $R^1$ and $R^2$, or $R^3$ and $R^4$ may be combined with each other to form a ring.

9. The phthalocyanine crystal according to the above item 1, wherein said organic acceptor compound contains a compound represented by the general formula (3):

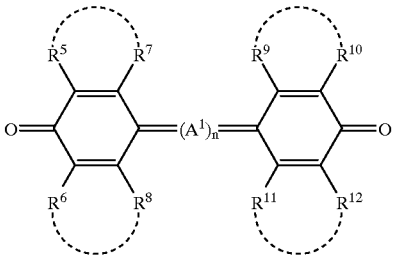

wherein $R^5$, $R^6$, $R^7$, $R^8$, $R^9$, $R^{10}$, $R^{11}$ and $R^{12}$ are the same or different and each represents a hydrogen atom, a halogen atom, or an alkyl, alkyl halide, alkoxy, aryl, aralkyl, cycloalkyl, cyano, nitro or amino group which may have a substituent, with a proviso that $R^5$ and $R^6$, $R^7$ and $R^8$, $R^9$ and $R^{10}$, or $R^{11}$ and $R^{12}$ may be combined with each other to form a ring; and $A^1$ represents a saturated or unsaturated alkyl group which may have a substituent, an aryl group, or a heterocycle which may have a substituent.

10. The phthalocyanine crystal according to the above item 1, wherein said organic acceptor compound contains a compound represented by the general formula (4):

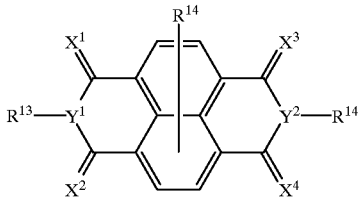

wherein $X^1$, $X^2$, $X^3$ and $X^4$ are the same or different and each represents an oxygen atom or $C(CN)_2$; $R^{13}$, $R^{14}$ and $R^{15}$ are the same or different and each represents a hydrogen atom, a halogen atom, or an alkyl, alkyl halide, alkoxy, aryl, aralkyl, cycloalkyl, cyano, nitro or amino group which may have a substituent; and $Y^1$ and $Y^2$ are the same or different and each represents a carbon atom, an oxygen atom, or a nitrogen atom.

11. The phthalocyanine crystal according to the above item 1, wherein said organic acceptor compound contains a compound represented by the general formula (5):

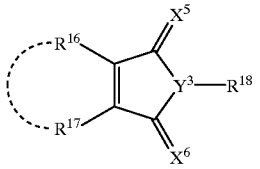

wherein $X^5$ and $X^6$ are the same or different and each represents an oxygen atom or $C(CN)_2$; and $R^{16}$, $R^{17}$ and $R^{18}$ are the same or different and each represents a hydrogen atom, a halogen atom, or an alkyl, alkyl halide, alkoxy, aryl, aralkyl, cycloalkyl, cyano, nitro or amino group which may have a substituent, with a proviso that $R^{16}$ and $R^{17}$ may be combined with each other to form a ring.

12. A phthalocyanine crystal in which an organic acceptor compound is associated with a phthalocyanine molecule, which is produced by adding the organic acceptor compound whose reduction potential to a reference electrode ($Ag^+/Ag$) is not less than −1.5 V and not more than −0.5 V during a step of converting into a pigment.

13. A method of producing a phthalocyanine crystal in which an organic acceptor compound is associated with a phthalocyanine molecule, a step of which comprises: dissolving said phthalocianine together with said organic acceptor compound whose reduction potential to a reference electrode ($Ag^+/Ag$) is not less than −1.5 V and not more than −0.5 V in a solvent capable of dissolving both of said phthalocyanine and said organic acceptor compound, adding the resulting solution to an aqueous methanol, thereby crystallizing said phthalocyanine associated with said organic acceptor compound.

14. An electrophotosensitive material comprising a conductive substrate and a photosensitive layer provided on the conductive substrate, wherein the photosensitive layer contains the phthalocyanine crystal of the above item 1 as an electric charge generating material.

15. An electrophotosensitive material comprising a conductive substrate and a photosensitive layer provided on the conductive substrate, wherein the photosensitive layer contains the phthalocyanine crystal of the above item 12 as an electric charge generating material.

16. The electrophotosensitive material according to the above item 14 or 15, which is a single-layer photosensitive material a layer of which comprises dispersing said phthalocyanine crystal and at least one of a hole transferring material and an electron transferring material into a binder resin.

17. The electrophotosensitive material according to the above item 16, wherein said single photosensitive layer contains both of the hole transferring material and the electron transferring material.

18. The electrophotosensitive material according to the above item 16, wherein said single photosensitive layer is formed by coating a coating solution which comprises adding said phthalocyanine crystal, at least one of the hole transferring material and the electron transferring material, and the binding resin to an organic solvent, and then drying the coated layer.

19. The electrophotosensitive material according to the above item 14 or 15, wherein said photosensitive layer is a laminated photosensitive layer which comprises laminating an electric charge generating layer containing said phthalocyanine crystal and an electric transferring layer containing at least one of a hole transferring material and an electron transferring material into a binder resin.
20. The electrophotosensitive material according to the above item 19, wherein said electric charge generating layer is formed by coating a coating solution which comprises adding said phthalocyanine crystal and the binding resin to an organic solvent, and then drying the coated layer.
21. The electrophotosensitive material according to the above item 16 or 19, wherein said binder resin contains a bis-Z type polycarbonate resin.

An electrophotosensitive material according to the present invention exhibits extra-high sensitivity. For example, it becomes possible to use the electrophotosensitive material even in high-speed image forming apparatuses because of its sufficient photosensitivity.

MODE FOR CARRING OUT THE INVENTION

Figure 1:
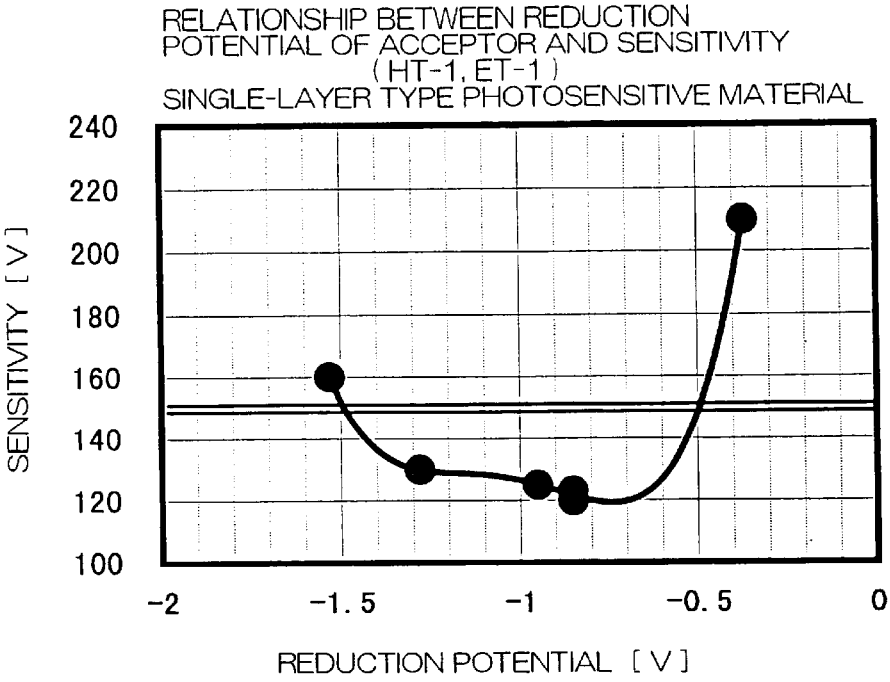
FIG. 1 is a graph showing a relationship between the reduction potential (V) of an organic acceptor compound and the potential after exposure $V_L$ (V) of a single-layer type photosensitive material (hole transferring material: HT-1, electron transferring material: ET-1).

According to the present invention, a photosensitive material containing, as an electric charge generating material, a phthalocyanine crystal which comprises associating with an organic acceptor compound in a photosensitive layer exhibits extra-high sensitivity. Said phthalocyanine crystal is produced during the step of converting into a pigment, not produced by merely adding the organic acceptor in the photosensitive layer. The reason is assumed as follows.

In the phthalocyanine crystal produced by adding the organic acceptor compound during the step of converting into a pigment, phthalocyanine molecules and organic acceptor compound molecules are associated in a molecular state and then crystallized as they are, so that an intermolecular distance of both molecules in the photosensitive layer is very small and both molecules are dispersed in the state where they are associated, which leads to the state where the organic acceptor compound is contained in the phthalocyanine crystal. It is, therefore, considered that the photosensitive material exhibits extra-high sensitivity because giving and receiving of electric charges generated in phthalocyanine are carried out very smoothly.

On the other hand, in the method of adding the organic acceptor compound during the step of preparing the coating solution for photosensitive layer, an intermolecular distance of both molecules in the photosensitive layer is comparatively long and, furthermore, crystallization and poor dispersion of the organic acceptor compound molecules occur and giving and receiving of electric charges are not carried out smoothly.

An organic acceptor compound in the present invention is an organic compound capable of acting as an electron acceptor. The organic acceptor compound is capable of forming associating molecules with phthalocyanine molecules. As described in the above item 1, it is necessary that the reduction potential of the organic acceptor to the reference electrode ($Ag^+/Ag$) is not less than −1.5 V and not more than −0.5 V. When the reduction potential of the organic acceptor potential is less than−1.5 V, the photosensitivity does not exhibit high sensitivity because of too weak acceptability. When the reduction potential of the organic acceptor potential is more than −0.5 V, the charging properties and sensitivity of the photosensitive material are drastically lowered because an increase in thermal carrier is caused by formation of a complex of the phthalocyanine and organic acceptor compound.

The reduction potential of the organic acceptor compound was determined by a cyclic voltammetry. The measurement conditions are shown below.

Work electrode: glassy carbon

Counter electrode: platinum

Reference electrode: silver/silver nitrate (0.1 mol/1$AgNO_3$-acetonitrile solution)

Sample Solution

Electrolyte: tetra-n-butylammonium perchlorate (0.1 mol)

Specimen: acceptor compound (0.001 mol)

Solvent: dichloromethane (1 L)

As is described in the above item 3, the solubility of the organic acceptor in the solvent in a coating solution for photosensitive layer is less than 10% by weight, particularly preferably. When the solubility is not less than 10% by weight, organic acceptor compound molecules associated with phthalocyanine molecules are liable to diffuse in the coating solution for photosensitive layer and the sensitizing effect of the photosensitive material is drastically lowered.

The electrophotosensitive material of the present invention may be an arbitrary photosensitive material, a single-layer photosensitive material containing an electric charge generating material and an electron charge transferring material in a single photosensitive layer, or a multi-layer photosensitive material comprising an electric charge generating layer and an electric charge transferring layer, which are mutually laminated, as far as it contains, as the electric charge material, a novel phthalocyanine crystal according to the present invention.

The constituent materials of the electrophotosensitive material of the present invention will be described in detail hereinafter.

<Electric Charge Generating Agent>

The electric charge generating material used in the electrophotosensitive material of the present invention may contain a phthalocyanine crystal which comprises associating with an organic acceptor compound whose reduction potential to a reference electrode ($Ag^+/Ag$) is not less than −1.5 V and not more than −0.5 V. Said phthalocianine can be produced during a step of converting into a pigment. These electric charge generating materials can be used alone, or can be used in combination with the other electric charge generating material.

The phthalocyanine in the present invention, as described hereinbefore, is a metal-free phthalocyanine or a metal phthalocyanine represented by the general formula (1).

The metal phthalocyanine represented by the general formula (1) includes, for example, aluminum phthalocyanine, vanadium phthalocyanine, cadmium phthalocyanine, antimony phthalocyanine, chromium phthalocyanine, copper 4-phthalocyanine, germanium phthalocyanine, iron phthalocyanine, chloroaluminum phthalocyanine, oxotitanyl phthalocyanine (CGM-2), chloroindium phthalocyanine, chlorogallium phthalocyanine, and magnesium phthalocyanine. The phthalocyanine of the general formula (1) is usually referred to as "metalophthalocyanine".The crystal form that can be used may be any of α, β, γ, δ, ϵ, σ, × and π forms.

(CGM-2)

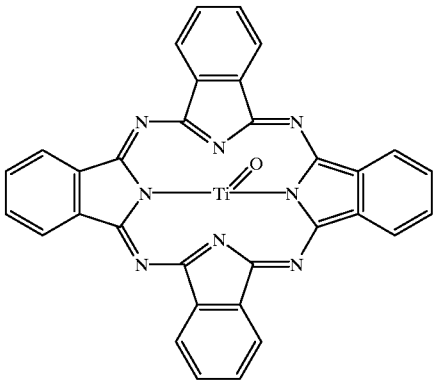

As the other electric charge generating material which can be used in combination of the phthalocyanine crystal of the present invention, there can be used various electric charge generating materials used conventionally in the photosensitive layer.

Examples thereof include selenium, selenium-tellurium, amorphous silicon, polycyclic quinone pigment, pyrylium pigment, squarium pigment, phthalocyanine pigment, azo pigment, disazo pigment, anthanthrone pigment, indigo pigment, threne pigment, toluidine pigment, pyrazoline pigment, perylene pigment, and quinacridone pigment.

As the organic acceptor compound, for example, there can be used compounds wherein a reduction potential to a reference electrode ($Ag^+/Ag$) is not less than −1.5 V and not more than −0.5 V and a solubility in a solvent in a coating solution for photosensitive layer is less than 10% by weight, as described above.

Particularly preferably organic acceptor compounds include specific quinone derivative, diphenoquinone derivative, naphthoquinone derivative, dinaphthoquinone derivative, and diimide naphthalenecarboxylate, as represented by the above general formulas (3), (4) and (5).

These organic acceptor compounds can be used alone, or can be used in combination with other organic acceptor compounds. Specific examples of the organic acceptor compound are shown below. The reduction potential value and solubility in tetrahydrofuran (THF) as the solvent in the coating solution for photosensitive layer were simultaneously shown.

(AC-1) Reduction Potential: −0.95 V
Solubility: 3% by weight (THF)

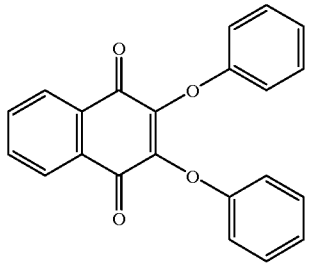

(AC-2) Reduction Potential: −0.85 V
Solubility: 3% by weight (THF)

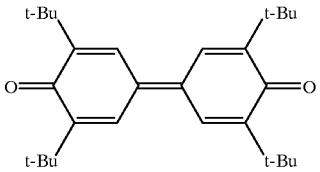

(AC-3) Reduction Potential: −0.85 V
Solubility: 1% by weight (THF)

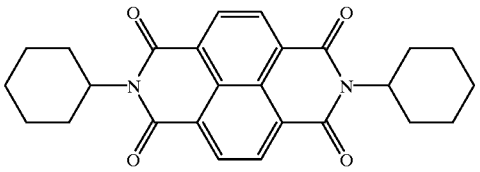

(AC-4) Reduction Potential: −1.28 V
Solubility: 3% by weight (THF)

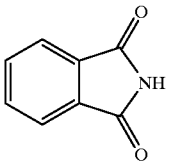

The phthalocyanine crystal of the present invention can be produced by a method descried in the above item (9) or (10). The phthalocyanine crystal of the above item (10) is characterized in that it is produced by adding the organic acceptor compound during the step of converting into a pigment.

The step of converting into a pigment refers to a step of dissolving phthalocyanine and an organic acceptor compound in a solvent (e.g. trihaloacetic acid such as trifluoroacetic acid or trichloroacetic acid, a mixed solvent of trihaloacetic acid/dichloromethane, and sulfuric acid) in which both of the phthalocyanine and organic acceptor compound dissolve at a temperature of 20 to 50° C., and adding dropwise the solution in a mixed solvent of water/methanol, thereby to deposit a crystal.

Then, the resulting crystal is washed with a solvent (e.g. methanol, etc.) having affinity with the dissolving solvent, washed with a large amount of a neutral solvent (e.g. water, etc.) to finally remove impurities (e.g. acid, alkali, etc.) until the filtrate becomes neutral, and then subjected to a dry or wet crystal converting step to convert into a desired crystal, which is sufficiently dried by vacuum drying.

The added amount of the organic acceptor compound is preferably not less than 0.5% by weight, and preferably not more than 100% by weight, based on the weight of phthalocyanine. When the amount of the organic acceptor is less than 0.5% by weight, the sensitizing effect is poor. On the other hand, when the amount is more than 100% by weight, the organic acceptor compound associated with a phthalocyanine molecule in the coating solution for photosensitive layer is liable to diffuse in the solvent, and a crystal made of only the organic acceptor compound is liable to be formed.

<Electric Charge Transferring Material>

As the electric charge transferring material used in the electrophotosensitive material of the present invention, there can be used various electric charge transferring materials which have conventionally been used in the photosensitive layer.

Examples of the electric charge transferring material include nitrogen-containing cyclic compounds as the hole transferring material, for example, oxadiazole compound such as 2,5-di(4-methylaminophenyl)-1,3,4-oxadiazole, styryl compound such as 9-4-(diethylaminostyryl) anthracene, carbazole compound such as polyvinylcarbazole, organic polysilane compound, pyrazoline compound such as 1-phenyl-3(p-dimethylaminophenyl) pyrazoline, hydazone compound, triphenylamine compound, indole compound, oxadiazole compound, isoxazole compound, thiazole compound, thiadiazole compound, imidazole compound, pyrazole compound, triazole compound, and stilbene compound; and electron transferring material, for example, pyrene compound, carbazole compound, hydrazone compound, N,N-dialkylaniline compound, diphenylamine compound, triphenylamine compound, naphthoquinone compound, pyrazoline compound, and styryl compound. These electric charge transferring materials can be used alone, or two or more kinds of them can be used in combination.

<Binder Resin>

As the binder resin used in the electrophotosensitive material of the present invention, for example, there can be used various resins which have conventionally been used in the photosensitive layer.

Examples of the binder resin include various polycarbonate resins having a bisphenol A skeleton or a bisphenol Z skeleton, polyacrylate, polyester resin, styrene-butadiene copolymer, styrene-acrylonitrile copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, alkyd resin, polyamide, polyurethane, polusulfone, diallyl phthalate resin, ketone resin, polyvinyl butyral resin, and polyether resin; crosslinkable thermosetting resins such as silicone resin, epoxy resin, phenol resin, urea resin, and melamine resin; and photocurable resins such as epoxy acrylate and urethane acrylate. These binder resins can be used alone, or two or more kinds of them can be used in combination.

Particularly preferred resin includes, for example, bisphenol Z type monomer and bisphenol Z type polycarbonate derived from phosgene, such as Panlight manufactured by Teijin Chemicals Co., Ltd. and PCZ manufactured by Mitsubishi Gas Chemicals Co., Ltd. The weight-average molecular weight of the binder resin is preferably within a range from 5,000 to 200,000, and more preferably from 15,000 to 100,000.

In case of the single-layer type, the film thickness of the photosensitive layer is preferably within a range from about 5 to 100 μm, and more preferably from about 10 to 50 μm. The electric charge generating material is preferably contained in the amount within a range from 0.1 to 50% by weight, and preferably from 0.5 to 30% by weight, based on the weight of the binder resin. The electron transferring material is preferably contained in the amount within a range from 20 to 500% by weight, and more preferably from 30 to 200%, based on the weight of the binder resin. In case of the single-layer type, the hole transferring material and electron transferring material are preferably used in combination as the electric charge transferring material.

In case where the photosensitive layer has a multi-layer structure, the film thickness of the electric charge generating layer preferably within a range from about 0.01 to 5 μm, and more preferably from about 0.1 to 3 g m. The film thickness of the electric charge transferring layer preferably within a range from about 2 to 100 μm, and more preferably from about 5 to 50 μm. The electric charge generating material is preferably contained in the electric charge generating layer in the amount within a range from 0.1 to 50% by weight, and preferably from 0.5 to 30% by weight, based on the weight of the whole binder resin. The electron transferring material is preferably contained in the electron transferring layer in the amount within a range from 20 to 500% by weight, and more preferably from 30 to 200%, based on the weight of the whole binder resin.

The single-layer type and multi-layer type photosensitive materials can be applied to any of positive charging type and negative charging type. It is particularly preferred that the single-layer type photosensitive material is used in the positive charging type, whereas, the multi-layer type photosensitive material is used in the negative charging type. When using the multi-layer type photosensitive material in the negative charging type, an electric charge generating layer and electric charge transferring layer are laminated from the substrate side in this sequence.

In addition to the above respective components, various conventionally known additives such as antioxidants, radical scavengers, singlet quenchers, deterioration inhibitors (e.g. ultraviolet absorbers), softeners, plasticizers, surface modifiers, extenders, thickeners, dispersion stabilizers, waxes, acceptors, and donors can be incorporated into the photosensitive layer as far as these additives do not exert a deleterious influence on electrophotographic characteristics. To improve the sensitivity of the photosensitive layer, for example, known sensitizers such as terphenyl, halonaphthoquinones, and acenaphthylene may be used in combination with the electric charge generating material.

An undercoat layer may be formed between the substrate and photosensitive layer as far as it does not inhibit the characteristics of the photosensitive material. A protective (overcoat) layer may be formed on the surface of the photosensitive material.

As the substrate on which the photosensitive layer is formed, for example, various materials having the conductivity can be used. The substrate includes, for example, metallic simple substances such as iron, aluminum, copper, tin, platinum, silver, vanadium, molybdenum, chromium, cadmium, titanium, nickel, palladium, indium, stainless steel, and brass; plastic materials prepared by depositing or laminating the above metal; and glasses coated with aluminum iodide, tin oxide, and indium oxide.

The substrate may be in the form of a sheet or drum according to the structure of the image forming apparatus to be used. The substrate itself may have the conductivity, or the surface of the substrate may have the conductivity. The substrate may be preferably those having a sufficient mechanical strength on use.

When the photosensitive layer is formed by the coating method, a dispersion is prepared by dispersing and mixing the above electric charge generating material, electric charge transferring material and binder resin, together with a proper solvent, using a known method such as roll mill, ball mill, attritor, paint shaker, and ultrasonic dispersing equipment, and then the resulting dispersion is coated by using a known means and dried.

As the solvent for preparing the dispersion, various organic solvents can be used. The organic solvent includes, for example, alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ethers such as dimethyl ether, diethyl ether, tetrahydrofuran, ethylene glycol dimethyl ether, and diethylene glycol dimethyl ether; ketones such as acetone, methyl ethyl ketone, and cylohexanone; esters such as ethyl acetate and methyl acetate; and dimethylformaldehyde, dimethylformamide, and dimethyl sulfoxide. These solvents can be used alone, or two or more kinds of them can be used in combination.

To improve the dispersion properties of the electric charge generating material and electric charge transferring material, and the smoothness of the surface of the photosensitive layer, for example, various coupling agents, various surfactants, and various leveling agents such as silicone oil may be used.

EXAMPLES

The following Synthesis Examples, Synthesis Comparative Examples, Examples and Comparative Examples further illustrate the present invention in detail. The following embodiments are illustrative, and they should not be construed to limit the technical scope of the present invention.

Synthesis Example 1

Synthesis of Titanyl Phthalocyanine Crystal (CG-1)

In a flask wherein the atmosphere was replaced by argon, 1,3-diiminoisoindoline (25 g), titanium tetrabutoxide (CGM-2)(14.6 g) and diphenylmethane (300 g) were mixed and heated to 150° C. While vapor generated in the flask was distilled out of the reaction system, the temperature in the system was raised to 200° C. Then, the mixture was reacted by stirring for additional four hours.

After the completion of the reaction, the temperature in the system was cooled to 150° C., the reaction mixture was filtered through a glass filter. The resulting solid was washed twice with previously heated dimethylformamide (DMF), washed with DMF and methanol, and then vacuum-dried to obtain titanyl phthalocyanine (24 g).

Titanyl phthalocyanine (5 g) and AC-1 (0.2 g) as the organic acceptor compound were mixed and the mixture was dissolved in 100 ml of a mixed solution of dichloromethane/trifluoroacetic acid (volume ratio of 4:1). The resulting solution was added dropwise in 1 L of methanol/water (volume ratio: 1:1). After the completion of the dropwise addition, the reaction solution was stirred at room temperature for 15 minutes, allowed to stand for 30 minutes and then filtered through a glass filter. The resulting solid was washed with water until the filtrate becomes neutral, redispersed in 200 ml of chlorobenzene, and then filtered through a glass filter after stirring for one hour. The resulting solid was vacuum-dried at 50° C. for five hours to obtain 4.2 g of a titanyl phthalocyanine crystal (CG-1)of the present invention.

Synthesis Examples 2, 3 and 4

Synthesis of Titanyl Phthalocyanine Crystals (CG-2, CG-3 and CG-4)

In the same manner as in Synthesis Example 1, except that AC-2, AC-3 and AC-4 were used as the organic acceptor compound, titanyl phthalocyanine crystals (CG-2, CG-3 and CG-4) were obtained.

Synthesis Comparative Examples 1, 2, 3 and 4

Synthesis of Titanyl Phthalocyanine Crystals (CG-5, CG-6, CG-7 and CG-8)

In the same manner as in Synthesis Example 1, except that AC-5, AC-6, AC-7 and AC-8 were used as the organic acceptor compound, titanyl phthalocyanine crystals (CG-5, CG-6, CG-7 and CG-8) were obtained.

(AC-5) Reduction Potential: −1.53 V

Solubility: 5% by weight (THF)

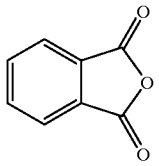

(AC-6) Reduction Potential: −1.32 V

Solubility: 20% by weight (THF)

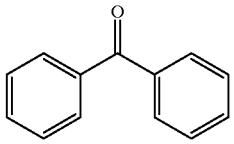

(AC-7) Reduction Potential: −0.37 V

Solubility: 3% by weight (THF)

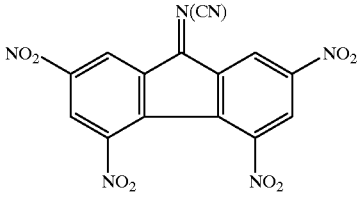

(AC-8) Reduction Potential: −1.31 V

Solubility: 11% by weight (THF)

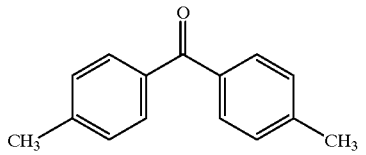

Synthesis Comparative Example 5

Synthesis of Titanyl Phthalocyanine Crystal (CG-9)

In the same manner as in Synthesis Example 1, except that no organic acceptor compound was used, a titanyl phthalocyanine crystal (CG-9) were obtained.

Examples 1 to 144

Single-layer Type Photosensitive Material

One kind (5 parts by weight) selected from the titanyl phthalocyanine crystals (CG-1 to CG-4) obtained in Synthesis Examples 1 to 4 as the electric charge generating material, one kind (70 parts by weight) selected from HT-1 to HT-15 as the hole transferring material, one kind (30 parts by weight) selected from ET-1 to ET-3 as the electron transferring material, a bis-Z type polycarbonate resin (100 parts by weight) having a weight-average molecular weight of 50,000 as the binder resin and tetrahydrofuran (800 parts by weight) were dispersed or dissolved using an ultrasonic dispersing apparatus to prepare a coating solution for single-layer type photosensitive layer. Then, an alumina tube as the substrate was coated with the coating solution according to a dip coating method, followed by hot-air drying at 110° C. for one hour to form a single-layer type photosensitive material having a photosensitive layer of 25 $\mu$m in a film thickness.

Comparative Examples 1 to 36

Single-layer Type Photosensitive Material

In the same manner as in Examples 1 to 144, except that the titanyl phthalocyanine crystal (CG-9) obtained in Synthesis Comparative Example 5 was used as the electric charge generating material, single-layer type photosensitive materials were produced.

Comparative Examples 37 to 40

Single-layer Type Photosensitive Material

In the same manner as in Examples 1 to 144, except that the titanyl phthalocyanine crystals (CG-5, CG-6, CG-7 and CG-8) obtained in Synthesis Comparative Examples 1, 2, 3 and 4 were used as the electric charge generating material, single-layer type photosensitive materials were produced.

Comparative Example 41

Single-layer Type Photosensitive Material

In the same manner as in Comparative Examples 1 to 36, except that 0.2 parts by weight of AC-1 as the organic acceptor compound was directly added (simple addition) in the coating solution for photosensitive layer, a single-layer type photosensitive material was produced.

Examples 145 to 205

Multi-layer Type Photosensitive Material

One kind (250 parts by weight) selected from the titanyl phthalocyanine crystals (CG-1 to CG-4) obtained in Synthesis Examples 1 to 4 as the electric charge generating material, polyvinyl butyral (100 parts by weight) having a weight-average molecular weight of 2,000 as the binder resin and tetrahydrofuran (1,500 parts by weight) were dispersed using an ultrasonic dispersing apparatus to prepare a coating solution for electric charge generating layer.

On the other hand, one kind (100 parts by weight) selected from HT-1 to HT-15 as the hole transferring material, a bis-Z type polycarbonate resin (100 parts by weight) having a weight-average molecular weight of 50,000 as the binder resin and toluene (1000 parts by weight) were dispersed using an ultrasonic dispersing apparatus to prepare a coating solution for electric charge transferring layer.

Then, an alumina tube as the substrate was coated with the coating solution according to a dipping method, followed by hot-air drying at 110° C. for 20 minutes to form an electric charge generating layer having a film thickness of 0.5 g in. Then, the electric charge generating layer was coated with the coating solution for electric charge transferring layer according to a dip coating method, followed by hot-air drying at 110° C. for 40 minutes to form a multi-layer type photosensitive material having a film thickness of 20 $\mu$m.

Comparative Examples 42 to 56

Multi-layer Type Photosensitive Material

In the same manner as in Examples 146 to 205, except that the titanyl phthalocyanine crystal (CG-9) obtained in Synthesis Comparative Example 5 was used as the electric charge generating material, multi-layer type photosensitive materials were produced.

Comparative Examples 57 to 60

Multi-layer Type Photosensitive Material

In the same manner as in Examples 145 to 205, except that the titanyl phthalocyanine crystals (CG-5, CG-6, CG-7 and CG-8) obtained in Synthesis Comparative Examples 1, 2, 3 and 4 were used as the electric charge generating material, multi-layer type photosensitive materials were produced.

Comparative Example 61

Multi-layer Type Photosensitive Material

In the same manner as in Comparative Examples 42 to 56, except that 10 parts by weight of AC-1 as the organic acceptor compound was directly added (simple addition) in the coating solution for electric charge generating layer, a coating solution for electric charge generating layer was produced. In the same manner as in Comparative Examples 42 to 56, except that the coating solution for electric charge generating layer was produced, a multi-layer type photosensitive material was produced.

(HT-1)
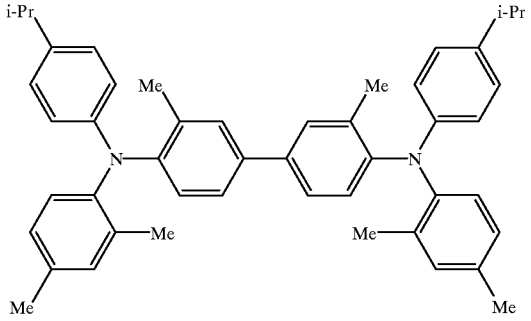
(HT-2)
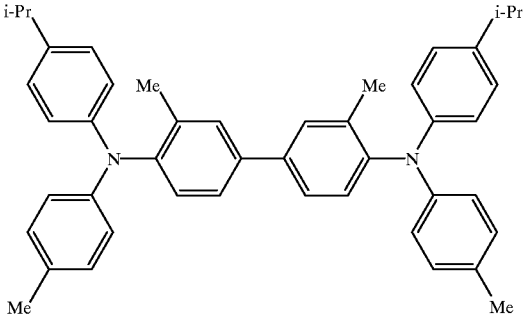
(HT-3)
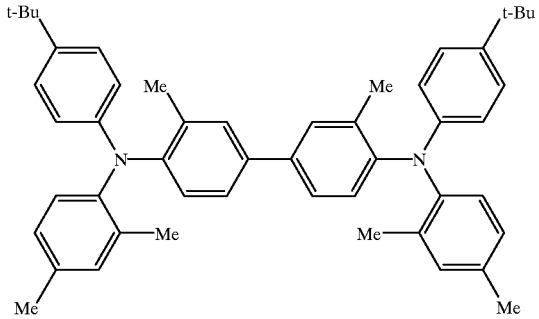
(HT-4)
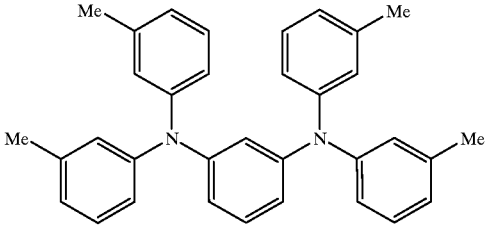
(HT-5)
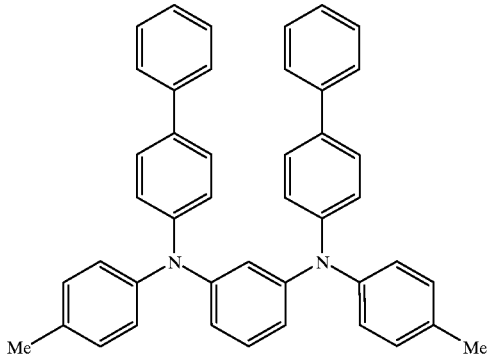
(HT-6)
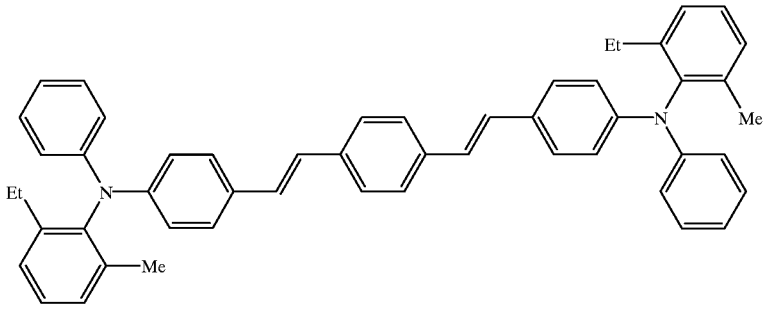

-continued
(HT-7)
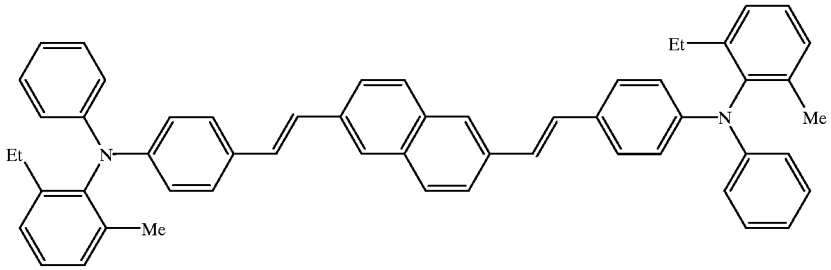
(HT-8)
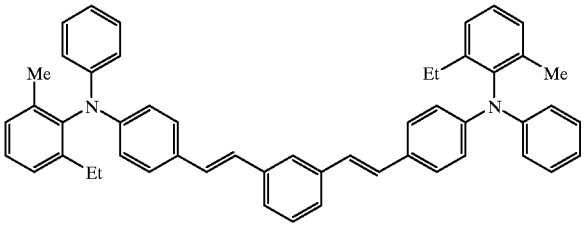
(HT-9)
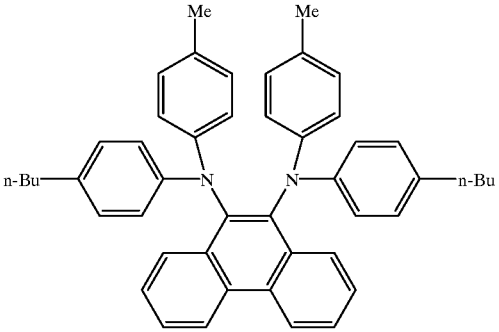
(HT-10)
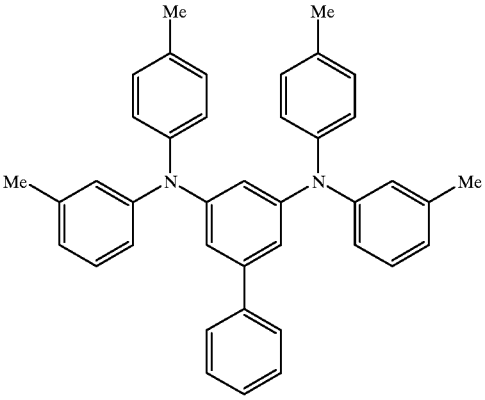
(HT-11)
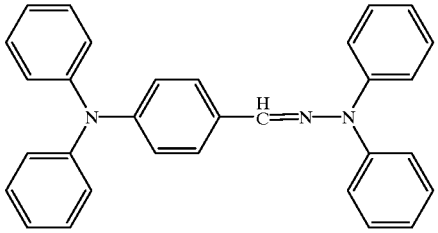
(HT-12)
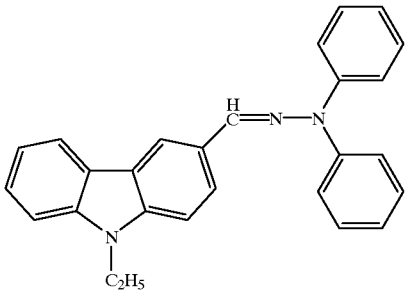
(HT-13)
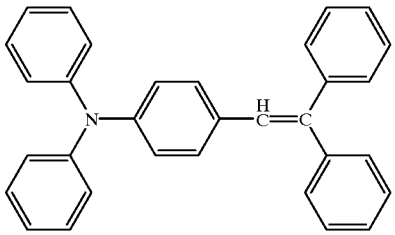
(HT-14)
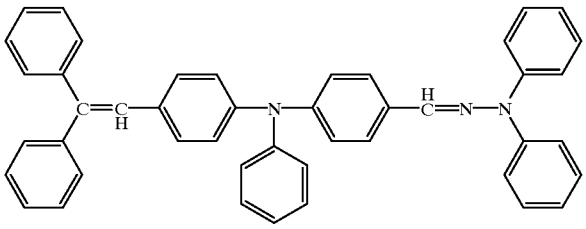
(HT-15)
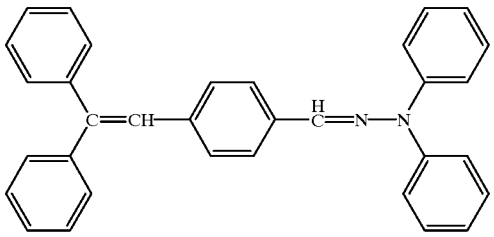

-continued (ET-1)

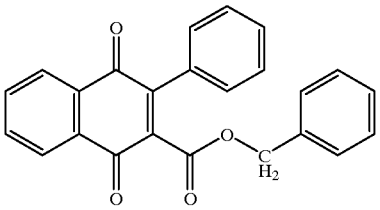

(ET-2)

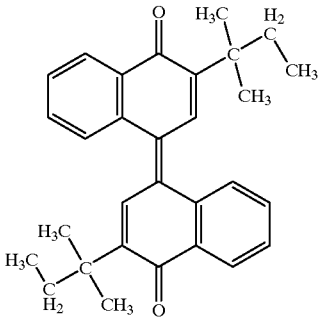

(ET-3)

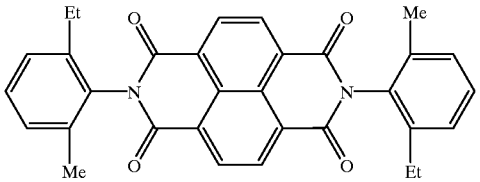

The photosensitive materials of the respective Examples and Comparative Examples were subjected to the following test and their characteristics were evaluated.

Evaluation of Initial Sensitivity of Single-layer Type Photosensitive Material

Using a drum sensitivity tester (Model GENTEC SINCIA 30 M) manufactured by GENTEC Co., a voltage was applied on the surface of the photosensitive materials of the respective Examples and Comparative Examples to charge the surface at +700 V.

Then, the surface of each photosensitive material (exposure time: 80 msec.) was irradiated with monochromic light having a wavelength of 780 nm (half-width: 20 nm, light intensity: 15 $\mu$W/cm$^2$) from white light of a halogen lamp as an exposure light source through a band-pass filter, and then a surface potential at the time at which 330 msec. have passed since the beginning of exposure was measured as a potential after exposure $V_L$ (V). The smaller the potential after exposure, the higher the sensitivity of the photosensitive material.

Evaluation of Initial Sensitivity of Multi-layer Type Photosensitive Material

In the same manner as in case of the single-layer photosensitive material, except that the surface of the photosensitive material was charged at −700 V, the initial sensitivity was evaluated.

Figure 2:
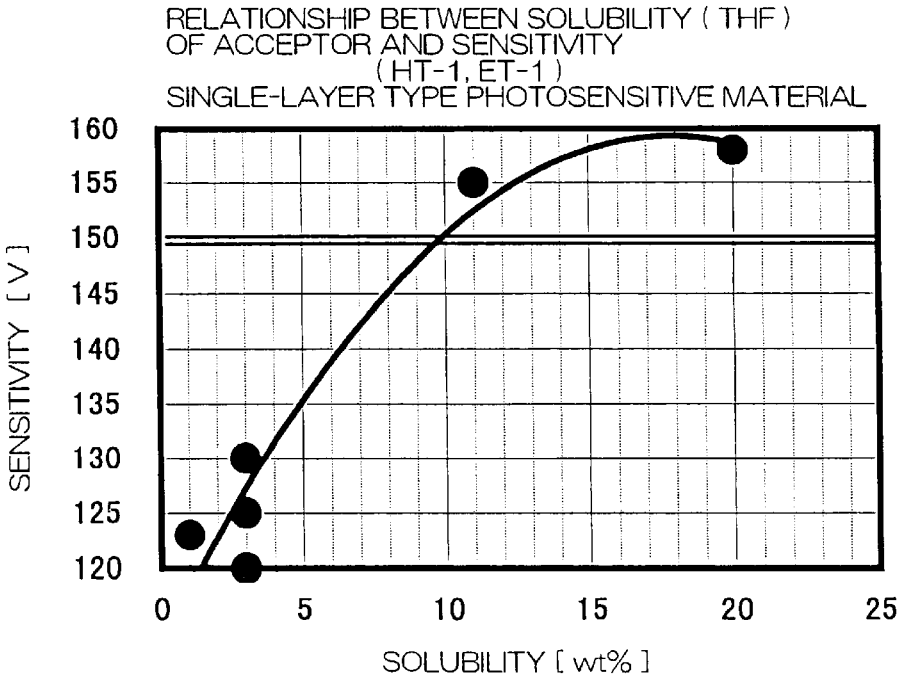
FIG. 2 is a graph showing a relationship between the solubility (% by weight) of an organic acceptor compound to THF and the potential after exposure $V_L$ (V) of a single-layer type photosensitive material (hole transferring material: HT-1, electron transferring material: ET-1). In a single-layer type photosensitive material using a hole transferring material HT-1 and an electron transferring material ET-1, the case where $V_L$ is not more than 150 V was rated "pass", whereas, the case where $V_L$ exceeds 150 V was rated "fail". The double line in the drawing means this boundary value.
Figure 3:
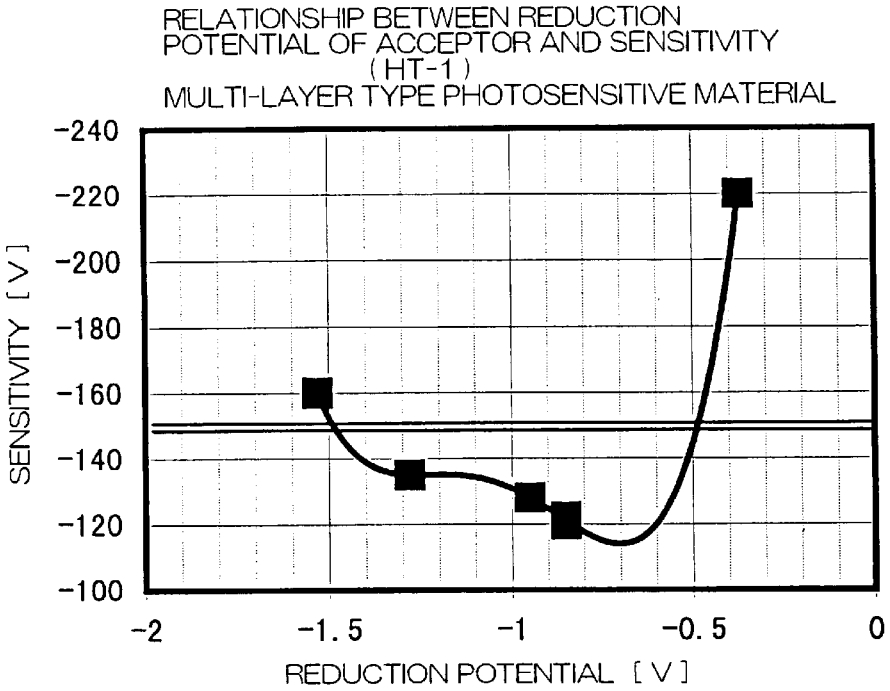
FIG. 3 is a graph showing a relationship between the reduction potential (V) of an organic acceptor compound and the potential after exposure $V_L$ (V) of a multi-layer type photosensitive material (hole transferring material: HT-1).
Figure 4:
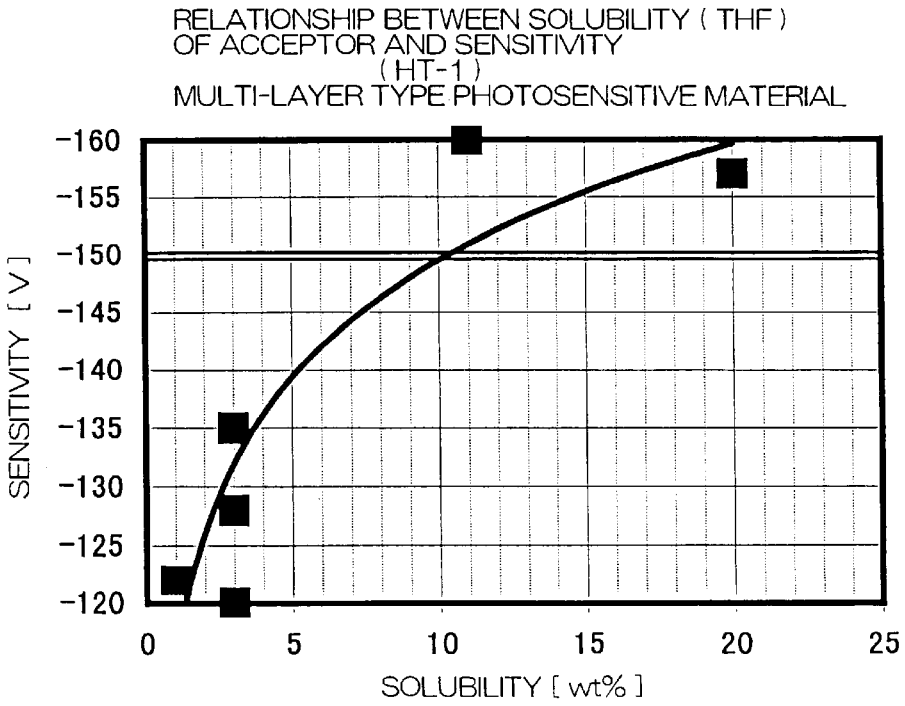
FIG. 4 is a graph showing a relationship between the solubility (% by weight) of an organic acceptor compound to THF and the potential after exposure $V_L$ (V) of a multi-layer type photosensitive material (hole transferring material: HT-1). In a single-layer type photosensitive material using a hole transferring material HT-1, the case where $V_L$ is not less than −150 V was rated "pass", whereas, the case where $V_L$ is less than −150 V was rated "fail". The double line in the drawing means this boundary value.

The results are shown in Tables 1 to 6 and FIGS. 1 to 4.

TABLE 1

| | | Electric charge generating material | Organic acceptor | Reduction potential [V] | Solubility/THF [% by weight] | Hole transferring material | Electron transferrring material | Vr [V] | Vr calculated based on Vr (100) of Comparative Example |
|---|---|---|---|---|---|---|---|---|---|
| Single-layer type photosensitive material | Example 1 | CG-1 | AC-1 | −0.95 | 3 | HT-1 | ET-1 | 125 | 83 |
| | Example 2 | CG-2 | AC-2 | −0.85 | 3 | HT-1 | ET-1 | 120 | 79 |
| | Example 3 | CG-3 | AC-3 | −0.85 | 1 | HT-1 | ET-1 | 123 | 81 |
| | Example 4 | CG-4 | AC-4 | −1.28 | 3 | HT-1 | ET-1 | 130 | 86 |
| | Comp. Example 1 | CG-9 | No addition | — | — | HT-1 | ET-1 | 151 | 100 |
| | Example 5 | CG-1 | AC-1 | −0.95 | 3 | HT-4 | ET-1 | 165 | 92 |
| | Example 6 | CG-2 | AC-2 | −0.85 | 3 | HT-4 | ET-1 | 158 | 88 |
| | Example 7 | CG-3 | AC-3 | −0.85 | 1 | HT-4 | ET-1 | 162 | 90 |
| | Example 8 | CG-4 | AC-4 | −1.28 | 3 | HT-4 | ET-1 | 168 | 93 |
| | Comp. Example 2 | CG-9 | No addition | — | — | HT-4 | ET-1 | 180 | 100 |
| | Example 9 | CG-1 | AC-1 | −0.95 | 3 | HT-5 | ET-1 | 168 | 94 |
| | Example 10 | CG-2 | AC-2 | −0.85 | 3 | HT-5 | ET-1 | 166 | 93 |
| | Example 11 | CG-3 | AC-3 | −0.85 | 1 | HT-5 | ET-1 | 168 | 94 |
| | Example 12 | CG-4 | AC-4 | −1.28 | 3 | HT-5 | ET-1 | 170 | 96 |
| | Comp. Example 3 | CG-9 | No addition | — | — | HT-5 | ET-1 | 178 | 100 |
| | Example 13 | CG-1 | AC-1 | −0.95 | 3 | HT-6 | ET-1 | 103 | 79 |
| | Example 14 | CC-2 | AC-2 | −0.85 | 3 | HT-6 | ET-1 | 99 | 76 |
| | Example 15 | CG-3 | AC-3 | −0.85 | 1 | HT-6 | ET-1 | 102 | 78 |
| | Example 16 | CG-4 | AC-4 | −1.28 | 3 | HT-6 | ET-1 | 109 | 84 |
| | Comp. Example 4 | CG-9 | No addition | — | — | HT-6 | ET-1 | 130 | 100 |
| | Example 17 | CG-1 | AC-1 | −0.95 | 3 | HT-8 | ET-1 | 162 | 94 |
| | Example 18 | CG-2 | AC-2 | −0.85 | 3 | HT-8 | ET-1 | 155 | 90 |

TABLE 1-continued

| | | Electric charge generating material | Organic acceptor | Reduction potential [V] | Solubility/THF [% by weight] | Hole transferring material | Electron transferrring material | Vr [V] | Vr calculated based on Vr (100) of Comparative Example |
|---|---|---|---|---|---|---|---|---|---|
| | Example 19 | CG-3 | AC-3 | −0.85 | 1 | HT-8 | ET-1 | 158 | 92 |
| | Example 20 | CG-4 | AC-4 | −1.28 | 3 | HT-8 | ET-1 | 165 | 96 |
| | Comp. Example 5 | CG-9 | No addition | — | — | HT-8 | ET-1 | 172 | 100 |
| | Example 21 | CG-1 | AC-1 | −0.95 | 3 | HT-9 | ET-1 | 124 | 90 |
| | Example 22 | CG-2 | AC-2 | −0.85 | 3 | HT-9 | ET-1 | 117 | 85 |
| | Example 23 | CG-3 | AC-3 | −0.85 | 1 | HT-9 | ET-1 | 122 | 88 |
| | Example 24 | CG-4 | AC-4 | −1.28 | 3 | HT-9 | ET-1 | 130 | 94 |
| | Comp. Example 6 | CG-9 | No addition | — | — | HT-9 | ET-1 | 138 | 100 |
| | Example 25 | CG-1 | AC-1 | −0.95 | 3 | HT-10 | ET-1 | 174 | 96 |
| | Example 26 | CG-2 | AC-2 | −0.85 | 3 | HT-10 | ET-1 | 171 | 94 |
| | Example 27 | CG-3 | AC-3 | −0.85 | 1 | HT-10 | ET-1 | 173 | 95 |
| | Example 28 | CG-4 | AC-4 | −1.28 | 3 | HT-10 | ET-1 | 178 | 98 |
| | Comp. Example 7 | CG-9 | No addition | — | — | HT-10 | ET-1 | 182 | 100 |
| | Example 29 | CG-1 | AC-1 | −0.95 | 3 | HT-11 | ET-1 | 152 | 93 |
| | Example 30 | CG-2 | AC-2 | −0.85 | 3 | HT-11 | ET-1 | 150 | 92 |
| | Example 31 | CG-3 | AC-3 | −0.85 | 1 | HT-11 | ET-1 | 153 | 94 |
| | Example 32 | CG-4 | AC-4 | −1.28 | 3 | HT-11 | ET-1 | 158 | 97 |
| | Comp. Example 8 | CG-9 | No addition | — | — | HT-11 | ET-1 | 163 | 100 |
| | Example 33 | CG-1 | AC-1 | −0.95 | 3 | HT-12 | ET-1 | 143 | 91 |
| | Example 34 | CG-2 | AC-2 | −0.85 | 3 | HT-12 | ET-1 | 140 | 89 |
| | Example 35 | CG-3 | AC-3 | −0.85 | 1 | HT-12 | ET-1 | 141 | 90 |
| | Example 36 | CG-4 | AC-4 | −1.28 | 3 | HT-12 | ET-1 | 147 | 94 |
| | Comp. Example 9 | CG-9 | No addition | — | — | HT-12 | ET-1 | 157 | 100 |
| | Example 37 | CG-1 | AC-1 | −0.95 | 3 | HT-13 | ET-1 | 133 | 89 |
| | Example 38 | CG-2 | AC-2 | −0.85 | 3 | HT-13 | ET-1 | 131 | 87 |
| | Example 39 | CG-3 | AC-3 | −0.85 | 1 | HT-13 | ET-1 | 133 | 89 |
| | Example 40 | CG-4 | AC-4 | −1.28 | 3 | HT-13 | ET-1 | 139 | 93 |
| | Comp. Example 10 | CG-9 | No addition | — | — | HT-13 | ET-1 | 150 | 100 |
| | Example 41 | CG-1 | AC-1 | −0.95 | 3 | HT-14 | ET-1 | 135 | 92 |
| | Example 42 | CG-2 | AC-2 | −0.85 | 3 | HT-14 | ET-1 | 131 | 90 |
| | Example 43 | CG-3 | AC-3 | −0.85 | 1 | HT-14 | ET-1 | 133 | 91 |
| | Example 44 | CG-4 | AC-4 | −1.28 | 3 | HT-14 | ET-1 | 140 | 96 |
| | Comp. Example 11 | CG-9 | No addition | — | — | HT-14 | ET-1 | 146 | 100 |
| | Example 45 | CG-1 | AC-1 | −0.95 | 3 | HT-15 | ET-1 | 118 | 90 |
| | Example 46 | CG-2 | AC-2 | −0.85 | 3 | HT-15 | ET-1 | 114 | 87 |
| | Example 47 | CG-3 | AC-3 | −0.85 | 1 | HT-15 | ET-1 | 117 | 89 |
| | Example 48 | CG-4 | AC-4 | −1.28 | 3 | HT-15 | ET-1 | 123 | 94 |
| | Comp. Example 12 | CG-9 | No addition | — | — | HT-15 | ET-1 | 131 | 100 |

TABLE 2

| | | Electric charge generating material | Organic acceptor | Reduction potential [V] | Solubility/THF [% by weight] | Hole transferring material | Electron transferrring material | Vr [V] | Vr calculated based on Vr (100) of Comparative Example |
|---|---|---|---|---|---|---|---|---|---|
| Single-layer type photosensitive material | Example 49 | CG-1 | AC-1 | −0.95 | 3 | HT-1 | ET-1 | 117 | 91 |
| | Example 50 | CG-2 | AC-2 | −0.85 | 3 | HT-1 | ET-2 | 114 | 89 |
| | Example 51 | CG-3 | AC-3 | −0.85 | 1 | HT-1 | ET-2 | 116 | 91 |
| | Example 52 | CG-4 | AC-4 | −1.28 | 3 | HT-1 | ET-2 | 123 | 96 |
| | Comp. Example 13 | CG-9 | No addition | — | — | HT-1 | ET-2 | 128 | 100 |
| | Example 53 | CG-1 | AC-1 | −0.95 | 3 | HT-4 | ET-2 | 160 | 94 |
| | Example 54 | CG-2 | AC-2 | −0.85 | 3 | HT-4 | ET-2 | 156 | 91 |
| | Example 55 | CG-3 | AC-3 | −0.85 | 1 | HT-4 | ET-2 | 160 | 94 |
| | Example 56 | CG-4 | AC-4 | −1.28 | 3 | HT-4 | ET-2 | 168 | 98 |
| | Comp. Example 14 | CG-9 | No addition | — | — | HT-4 | ET-2 | 171 | 100 |
| | Example 57 | CG-1 | AC-1 | −0.95 | 3 | HT-5 | ET-2 | 164 | 94 |
| | Example 58 | CG-2 | AC-2 | −0.85 | 3 | HT-5 | ET-2 | 161 | 92 |
| | Example 59 | CG-3 | AC-3 | −0.85 | 1 | HT-5 | ET-2 | 166 | 95 |
| | Example 60 | CG-4 | AC-4 | −1.28 | 3 | HT-5 | ET-2 | 172 | 98 |
| | Comp. Example 15 | CG-9 | No addition | — | — | HT-5 | ET-2 | 175 | 100 |
| | Example 61 | CG-1 | AC-1 | −0.95 | 3 | HT-6 | ET-2 | 95 | 78 |
| | Example 62 | CG-2 | AC-2 | −0.85 | 3 | HT-6 | ET-2 | 92 | 75 |
| | Example 63 | CG-3 | AC-3 | −0.85 | 1 | HT-6 | ET-2 | 94 | 77 |
| | Example 64 | CG-4 | AC-4 | −1.28 | 3 | HT-6 | ET-2 | 100 | 82 |
| | Comp. Example 16 | CG-9 | No addition | — | — | HT-6 | ET-2 | 122 | 100 |
| | Example 65 | CG-1 | AC-1 | −0.95 | 3 | HT-8 | ET-2 | 160 | 94 |

TABLE 2-continued

| | Electric charge generating material | Organic acceptor | Reduction potential [V] | Solubility/THF [% by weight] | Hole transferring material | Electron transferrring material | Vr [V] | Vr calculated based on Vr (100) of Comparative Example |
|---|---|---|---|---|---|---|---|---|
| Example 66 | CG-2 | AC-2 | −0.85 | 3 | HT-8 | ET-2 | 154 | 91 |
| Example 67 | CG-3 | AC-3 | −0.85 | 1 | HT-8 | ET-2 | 159 | 94 |
| Ecample 68 | CG-4 | AC-4 | −1.28 | 3 | HT-8 | ET-2 | 165 | 97 |
| Comp. Example 17 | CG-9 | No addition | — | — | HT-8 | ET-2 | 170 | 100 |
| Example 69 | CG-1 | AC-1 | −0.95 | 3 | HT-9 | ET-2 | 115 | 88 |
| Example 70 | CG-2 | AC-2 | −0.85 | 3 | HT-9 | ET-2 | 112 | 86 |
| Example 71 | CG-3 | AC-3 | −0.85 | 1 | HT-9 | ET-2 | 114 | 88 |
| Example 72 | CG-4 | AC-4 | −1.28 | 3 | HT-9 | ET-2 | 122 | 94 |
| Comp. Example 18 | CG-9 | No addition | — | — | HT-9 | ET-2 | 130 | 100 |
| Example 73 | CG-1 | AC-1 | −0.95 | 3 | HT-10 | ET-2 | 170 | 93 |
| Example 74 | CG-2 | AC-2 | −0.85 | 3 | HT-10 | ET-2 | 168 | 92 |
| Example 75 | CG-3 | AC-3 | −0.85 | 1 | HT-10 | ET-2 | 171 | 94 |
| Example 76 | CG-4 | AC-4 | −1.28 | 3 | HT-10 | ET-2 | 175 | 96 |
| Comp. Example 19 | CG-9 | No addition | — | — | HT-10 | ET-2 | 182 | 100 |
| Example 77 | CG-1 | AC-1 | −0.95 | 3 | HT-11 | ET-2 | 147 | 92 |
| Example 78 | CG-2 | AC-2 | −0.85 | 3 | HT-11 | ET-2 | 144 | 90 |
| Example 79 | CG-3 | AC-3 | −0.85 | 1 | HT-11 | ET-2 | 146 | 91 |
| Example 80 | CG-4 | AC-4 | −1.28 | 3 | HT-11 | ET-2 | 150 | 94 |
| Comp. Example 20 | CG-9 | No addition | — | — | HT-11 | ET-2 | 160 | 100 |
| Example 81 | CG-1 | AC-1 | −0.95 | 3 | HT-12 | ET-2 | 140 | 90 |
| Example 82 | CG-2 | AC-2 | −0.85 | 3 | HT-12 | ET-2 | 136 | 88 |
| Example 83 | CG-3 | AC-3 | −0.85 | 1 | HT-12 | ET-2 | 140 | 90 |
| Example 84 | CG-4 | AC-4 | −1.28 | 3 | HT-12 | ET-2 | 145 | 94 |
| Comp. Example 21 | CG-9 | No addition | — | — | HT-12 | ET-2 | 155 | 100 |
| Example 85 | CG-1 | AC-1 | −0.95 | 3 | HT-13 | ET-2 | 131 | 89 |
| Example 86 | CG-2 | AC-2 | −0.85 | 3 | HT-13 | ET-2 | 128 | 87 |
| Example 87 | CG-3 | AC-3 | −0.85 | 1 | HT-13 | ET-2 | 130 | 88 |
| Example 88 | CG-4 | AC-4 | −1.28 | 3 | HT-13 | ET-2 | 136 | 93 |
| Comp. Example 22 | CG-9 | No addition | — | — | HT-13 | ET-2 | 147 | 100 |
| Example 89 | CG-1 | AC-1 | −0.95 | 3 | HT-14 | ET-2 | 133 | 92 |
| Example 90 | CG-2 | AC-2 | −0.85 | 3 | HT-14 | ET-2 | 127 | 88 |
| Example 91 | CG-3 | AC-3 | −0.85 | 1 | HT-14 | ET-2 | 130 | 90 |
| Example 92 | CG-4 | AC-4 | −1.28 | 3 | HT-14 | ET-2 | 138 | 95 |
| Comp. Example 23 | CG-9 | No addition | — | — | HT-14 | ET-2 | 145 | 100 |
| Example 93 | CG-1 | AC-1 | −0.95 | 3 | HT-15 | ET-2 | 115 | 88 |
| Example 94 | CG-2 | AC-2 | −0.85 | 3 | HT-15 | ET-2 | 111 | 85 |
| Example 95 | CG-3 | AC-3 | −0.85 | 1 | HT-15 | ET-2 | 114 | 88 |
| Example 96 | CG-4 | AC-4 | −1.28 | 3 | HT-15 | ET-2 | 121 | 93 |
| Comp. Example 24 | CG-9 | No addition | — | — | HT-15 | ET-2 | 130 | 100 |

TABLE 3

| | | Electric charge generating material | Organic acceptor | Reduction potential [V] | Solubility/THF [% by weight] | Hole transferring material | Electron transferrring material | Vr [V] | Vr calculated based on Vr (100) of Comparative Example |
|---|---|---|---|---|---|---|---|---|---|
| Single-layer type photosensitive material | Example 97 | CG-1 | AC-1 | −0.95 | 3 | HT-1 | ET-3 | 136 | 89.5 |
| | Example 98 | CG-2 | AC-2 | −0.85 | 3 | HT-1 | ET-3 | 133 | 87.5 |
| | Example 99 | CG-3 | AC-3 | −0.85 | 1 | HT-1 | ET-3 | 135 | 88.8 |
| | Example 100 | CG-4 | AC-4 | −1.28 | 3 | HT-1 | ET-3 | 141 | 92.8 |
| | Comp. Example 25 | CG-9 | No addition | — | — | HT-1 | ET-3 | 152 | 100.0 |
| | Example 101 | CG-1 | AC-1 | −0.95 | 3 | HT-4 | ET-3 | 180 | 95.7 |
| | Example 102 | CG-2 | AC-2 | −0.85 | 3 | HT-4 | ET-3 | 178 | 94.7 |
| | Example 103 | CG-3 | AC-3 | −0.85 | 1 | HT-4 | ET-3 | 179 | 95.2 |
| | Example 104 | CG-4 | AC-4 | −1.28 | 3 | HT-4 | ET-3 | 182 | 96.8 |
| | Comp. Example 26 | CG-9 | No addition | — | — | HT-4 | ET-3 | 188 | 100.0 |
| | Example 105 | CG-1 | AC-1 | −0.95 | 3 | HT-5 | ET-3 | 181 | 96.3 |
| | Example 106 | CG-2 | AC-2 | −0.85 | 3 | HT-5 | ET-3 | 178 | 94.7 |
| | Example 107 | CG-3 | AC-3 | −0.85 | 1 | HT-5 | ET-3 | 179 | 95.2 |
| | Example 108 | CG-4 | AC-4 | −1.28 | 3 | HT-5 | ET-3 | 183 | 97.3 |
| | Comp. Example 27 | CG-9 | No addition | — | — | HT-5 | ET-3 | 188 | 100.0 |
| | Example 109 | CG-1 | AC-1 | −0.95 | 3 | HT-6 | ET-3 | 115 | 82.1 |
| | Example 110 | CG-2 | AC-2 | −0.85 | 3 | HT-6 | ET-3 | 112 | 80.0 |
| | Example 111 | CG-3 | AC-3 | −0.85 | 1 | HT-6 | ET-3 | 115 | 82.1 |
| | Example 112 | CG-4 | AC-4 | −1.28 | 3 | HT-6 | ET-3 | 121 | 86.4 |
| | Comp. Example 28 | CG-9 | No addition | — | — | HT-6 | ET-3 | 140 | 100.0 |

TABLE 3-continued

| | Electric charge generating material | Organic acceptor | Reduction potential [V] | Solubility/THF [% by weight] | Hole transferring material | Electron transferrring material | Vr [V] | Vr calculated based on Vr (100) of Comparative Example |
|---|---|---|---|---|---|---|---|---|
| Example 113 | CG-1 | AC-1 | −0.95 | 3 | HT-8 | ET-3 | 171 | 92.4 |
| Example 114 | CG-2 | AC-2 | −0.85 | 3 | HT-8 | ET-3 | 167 | 90.3 |
| Example 115 | CG-3 | AC-3 | −0.85 | 1 | HT-8 | ET-3 | 169 | 91.4 |
| Example 116 | CG-4 | AC-4 | −1.28 | 3 | HT-8 | ET-3 | 173 | 93.5 |
| Comp. Example 29 | CG-9 | No addition | — | — | HT-8 | ET-3 | 185 | 100.0 |
| Example 117 | CG-1 | AC-1 | −0.95 | 3 | HT-9 | ET-3 | 135 | 88.2 |
| Example 118 | CG-2 | AC-2 | −0.85 | 3 | HT-9 | ET-3 | 133 | 86.9 |
| Example 119 | CG-3 | AC-3 | −0.85 | 1 | HT-9 | ET-3 | 134 | 87.6 |
| Example 120 | CG-4 | AC-4 | −1.28 | 3 | HT-9 | ET-3 | 139 | 90.8 |
| Comp. Example 30 | CG-9 | No addition | — | — | HT-9 | ET-3 | 153 | 100.0 |
| Example 121 | CG-1 | AC-1 | −0.95 | 3 | HT-10 | ET-3 | 179 | 90.9 |
| Example 122 | CG-2 | AC-2 | −0.85 | 3 | HT-10 | ET-3 | 175 | 88.8 |
| Example 123 | CG-3 | AC-3 | −0.85 | 1 | HT-10 | ET-3 | 176 | 89.3 |
| Example 124 | CG-4 | AC-4 | −1.28 | 3 | HT-10 | ET-3 | 182 | 92.4 |
| Comp. Example 31 | CG-9 | No addition | — | — | HT-10 | ET-3 | 197 | 100.0 |
| Example 125 | CG-1 | AC-1 | −0.95 | 3 | HT-11 | ET-3 | 166 | 89.7 |
| Example 126 | CG-2 | AC-2 | −0.85 | 3 | HT-11 | ET-3 | 164 | 88.6 |
| Example 127 | CG-3 | AC-3 | −0.85 | 1 | HT-11 | ET-3 | 165 | 89.2 |
| Example 128 | CG-4 | AC-4 | −1.28 | 3 | HT-11 | ET-3 | 171 | 92.4 |
| Comp. Example 32 | CG-9 | No addition | — | — | HT-11 | ET-3 | 185 | 100.0 |
| Example 129 | CG-1 | AC-1 | −0.95 | 3 | HT-12 | ET-3 | 155 | 90.6 |
| Example 130 | CG-2 | AC-2 | −0.85 | 3 | HT-12 | ET-3 | 152 | 88.9 |
| Example 131 | CG-3 | AC-3 | −0.85 | 1 | HT-12 | ET-3 | 153 | 89.5 |
| Example 132 | CG-4 | AC-4 | −1.28 | 3 | HT-12 | ET-3 | 159 | 93.0 |
| Comp. Example 33 | CG-9 | No addition | — | — | HT-12 | ET-3 | 171 | 100.0 |
| Example 133 | CG-1 | AC-1 | −0.95 | 3 | HT-13 | ET-3 | 144 | 88.9 |
| Example 134 | CG-2 | AC-2 | −0.85 | 3 | HT-13 | ET-3 | 142 | 87.7 |
| Example 135 | CG-3 | AC-3 | −0.85 | 1 | HT-13 | ET-3 | 142 | 87.7 |
| Example 136 | CG-4 | AC-4 | −1.28 | 3 | HT-13 | ET-3 | 147 | 90.7 |
| Comp. Example 34 | CG-9 | No addition | — | — | HT-13 | ET-3 | 162 | 100.0 |
| Example 137 | CG-1 | AC-1 | −0.95 | 3 | HT-14 | ET-3 | 145 | 89.5 |
| Example 138 | CG-2 | AC-2 | −0.85 | 3 | HT-14 | ET-3 | 140 | 86.4 |
| Example 139 | CG-3 | AC-3 | −0.85 | 1 | HT-14 | ET-3 | 145 | 89.5 |
| Example 140 | CG-4 | AC-4 | −1.28 | 3 | HT-14 | ET-3 | 151 | 93.2 |
| Comp. Example 35 | CG-9 | No addition | — | — | HT-14 | ET-3 | 162 | 100.0 |
| Example 141 | CG-1 | AC-1 | −0.95 | 3 | HT-15 | ET-3 | 129 | 90.2 |
| Example 142 | CG-2 | AC-2 | −0.85 | 3 | HT-15 | ET-3 | 128 | 89.5 |
| Example 143 | CG-3 | AC-3 | −0.85 | 1 | HT-15 | ET-3 | 130 | 90.9 |
| Example 144 | CG-4 | AC-4 | −1.28 | 3 | HT-15 | ET-3 | 133 | 93.0 |
| Comp. Example 36 | CG-9 | No addition | — | — | HT-15 | ET-3 | 143 | 100.0 |

TABLE 4

| | | Electric charge generating material | Organic acceptor | Redox potential | Solubility/THF [% by weight] | Hole transferring material | Electron transferring material | Vr [V] |
|---|---|---|---|---|---|---|---|---|
| Single-layer type photosensitive material | Example 1 | CG-1 | AC-1 | −0.95 | 3 | HT-1 | ET-1 | 125 |
| | Comp. Example 37 | CG-5 | AC-5 | −1.53 | 5 | HT-1 | ET-1 | 160 |
| | Comp. Example 38 | CG-6 | AC-6 | −1.32 | 20 | HT-1 | ET-1 | 158 |
| | Comp. Example 39 | CG-7 | AC-7 | −0.37 | 3 | HT-1 | ET-1 | 210 |
| | Comp. Example 40 | CG-8 | AC-8 | −1.31 | 11 | HT-1 | ET-1 | 155 |
| | Comp. Example 41 | CG-9 | AC-1 | −0.95 | 3 | HT-1 | ET-1 | 145 |

In Comparative Example 41, AC-1 was simply added and a crystal was deposited on the surface of the photosensitive layer.

TABLE 5

| | | Electric charge generating material | Organic acceptor | Reduction potential [V] | Solubility/THF [% by weight] | Hole transferring material | Vr [V] | Vr calculated based on Vr (100) of Comparative Example |
|---|---|---|---|---|---|---|---|---|
| Multi-layer type photosensitive material | Example 145 | CG-1 | AC-1 | −0.95 | 3 | HT-1 | −128 | 85.3 |
| | Example 146 | CG-2 | AC-2 | −0.85 | 3 | HT-1 | −120 | 80.0 |
| | Example 147 | CG-3 | AC-3 | −0.85 | 1 | HT-1 | −122 | 81.3 |
| | Example 148 | CG-4 | AC-4 | −1.28 | 3 | HT-1 | −135 | 90.0 |
| | Comp. Example 42 | CG-9 | No addition | — | — | HT-1 | −150 | 100.0 |
| | Example 149 | CG-1 | AC-1 | −0.95 | 3 | HT-4 | −108 | 80.0 |
| | Example 150 | CG-2 | AC-2 | −0.85 | 3 | HT-4 | −101 | 74.8 |
| | Example 151 | CG-3 | AC-3 | −0.85 | 1 | HT-4 | −110 | 81.5 |
| | Example 152 | CG-4 | AC-4 | −1.28 | 3 | HT-4 | −119 | 88.1 |
| | Comp. Example 43 | CG-9 | No addition | — | — | HT-4 | −135 | 100.0 |
| | Example 153 | CG-1 | AC-1 | −0.95 | 3 | HT-5 | −265 | 73.4 |
| | Example 154 | CG-2 | AC-2 | −0.85 | 3 | HT-5 | −250 | 69.3 |
| | Example 155 | CG-3 | AC-3 | −0.85 | 1 | HT-5 | −257 | 71.2 |
| | Example 156 | CG-4 | AC-4 | −1.28 | 3 | HT-5 | −267 | 74.0 |
| | Comp. Example 44 | CG-9 | No addition | — | — | HT-5 | −361 | 100.0 |
| | Example 157 | CG-1 | AC-1 | −0.95 | 3 | HT-6 | −113 | 88.3 |
| | Example 158 | CG-2 | AC-2 | −0.85 | 3 | HT-6 | −105 | 82.0 |
| | Example 159 | CG-3 | AC-3 | −0.85 | 1 | HT-6 | −111 | 86.7 |
| | Example 160 | CG-4 | AC-4 | −1.28 | 3 | HT-6 | −120 | 93.8 |
| | Comp. Example 45 | CG-9 | No addition | — | — | HT-6 | −128 | 100.0 |
| | Example 161 | CG-1 | AC-1 | −0.95 | 3 | HT-8 | −178 | 87.7 |
| | Example 162 | CG-2 | AC-2 | −0.85 | 3 | HT-8 | −170 | 83.7 |
| | Example 163 | CG-3 | AC-3 | −0.85 | 1 | HT-8 | −174 | 85.7 |
| | Example 164 | CG-4 | AC-4 | −1.28 | 3 | HT-8 | −195 | 96.1 |
| | Comp. Example 46 | CG-9 | No addition | — | — | HT-8 | −203 | 100.0 |
| | Example 165 | CG-1 | AC-1 | −0.95 | 3 | HT-9 | −85 | 84.2 |
| | Example 166 | CG-2 | AC-2 | −0.85 | 3 | HT-9 | −72 | 71.3 |
| | Example 167 | CG-3 | AC-3 | −0.85 | 1 | HT-9 | −82 | 81.2 |
| | Example 168 | CG-4 | AC-4 | −1.28 | 3 | HT-9 | −90 | 89.1 |
| | Comp. Example 47 | CG-9 | No addition | — | — | HT-9 | −101 | 100.0 |
| | Example 169 | CG-1 | AC-1 | −0.95 | 3 | HT-10 | −110 | 88.7 |
| | Example 170 | CG-2 | AC-2 | −0.85 | 3 | HT-10 | −105 | 84.7 |
| | Example 171 | CG-3 | AC-3 | −0.85 | 1 | HT-10 | −105 | 84.7 |
| | Example 172 | CG-4 | AC-4 | −1.28 | 3 | HT-10 | −115 | 92.7 |
| | Comp. Example 48 | CG-9 | No addition | — | — | HT-10 | −124 | 100.0 |
| | Example 173 | CG-1 | AC-1 | −0.95 | 3 | HT-11 | −120 | 91.6 |
| | Example 174 | CG-2 | AC-2 | −0.85 | 3 | HT-11 | −112 | 85.5 |
| | Example 175 | CG-3 | AC-3 | −0.85 | 1 | HT-11 | −119 | 90.8 |
| | Example 176 | CG-4 | AC-4 | −1.28 | 3 | HT-11 | −128 | 97.7 |
| | Comp. Example 49 | CG-9 | No addition | — | — | HT-11 | −131 | 100.0 |
| | Example 177 | CG-1 | AC-1 | −0.95 | 3 | HT-12 | −103 | 86.6 |
| | Example 178 | CG-2 | AC-2 | −0.85 | 3 | HT-12 | −95 | 79.8 |
| | Example 179 | CG-3 | AC-3 | −0.85 | 1 | HT-12 | −100 | 84.0 |
| | Example 180 | CG-4 | AC-4 | −1.28 | 3 | HT-12 | −111 | 93.3 |
| | Comp. Example 50 | CG-9 | No addition | — | — | HT-12 | −119 | 100.0 |
| | Example 181 | CG-1 | AC-1 | −0.95 | 3 | HT-13 | −138 | 89.0 |
| | Example 182 | CG-2 | AC-2 | −0.85 | 3 | HT-13 | −130 | 83.9 |
| | Example 183 | CG-3 | AC-3 | −0.85 | 1 | HT-13 | −132 | 85.2 |
| | Example 184 | CG-4 | AC-4 | −1.28 | 3 | HT-13 | −148 | 95.5 |
| | Comp. Example 51 | CG-9 | No addition | — | — | HT-13 | −155 | 100.0 |
| | Example 185 | CG-1 | AC-1 | −0.95 | 3 | HT-14 | −150 | 87.2 |
| | Example 186 | CG-2 | AC-2 | −0.85 | 3 | HT-14 | −140 | 81.4 |
| | Example 187 | CG-3 | AC-3 | −0.85 | 1 | HT-14 | −148 | 86.0 |
| | Example 188 | CG-4 | AC-4 | −1.28 | 3 | HT-14 | −165 | 95.9 |
| | Comp. Example 52 | CG-9 | No addition | — | — | HT-14 | −172 | 100.0 |
| | Example 189 | CG-1 | AC-1 | −0.95 | 3 | HT-15 | −150 | 87.2 |
| | Example 190 | CG-2 | AC-2 | −0.85 | 3 | HT-15 | −143 | 83.1 |
| | Example 191 | CG-3 | AC-3 | −0.85 | 1 | HT-15 | −143 | 83.1 |
| | Example 192 | CG-4 | AC-4 | −1.28 | 3 | HT-15 | −158 | 91.9 |
| | Comp. Example 53 | CG-9 | No addition | — | — | HT-15 | −172 | 100.0 |
| | Example 193 | CG-1 | AC-1 | −0.95 | 3 | HT-13 | −143 | 94.1 |
| | Example 194 | CG-2 | AC-2 | −0.85 | 3 | HT-13 | −135 | 88.8 |
| | Example 195 | CG-3 | AC-3 | −0.85 | 1 | HT-13 | −138 | 90.8 |
| | Example 196 | CG-4 | AC-4 | −1.28 | 3 | HT-13 | −149 | 98.0 |
| | Comp. Example 54 | CG-9 | No addition | — | — | HT-13 | −152 | 100.0 |
| | Example 197 | CG-1 | AC-1 | −0.95 | 3 | HT-14 | −138 | 86.3 |
| | Example 198 | CG-2 | AC-2 | −0.85 | 3 | HT-14 | −133 | 83.1 |
| | Example 199 | CG-3 | AC-3 | −0.85 | 1 | HT-14 | −134 | 83.8 |
| | Example 200 | CG-4 | AC-4 | −1.28 | 3 | HT-14 | −145 | 90.6 |
| | Comp. Example 55 | CG-9 | No addition | — | — | HT-14 | −160 | 100.0 |
| | Example 201 | CG-1 | AC-1 | −0.95 | 3 | HT-15 | −125 | 90.6 |
| | Example 202 | CG-2 | AC-2 | −0.85 | 3 | HT-15 | −120 | 87.0 |

TABLE 5-continued

| | | Electric charge generating material | Organic acceptor | Reduction potential [V] | Solubility/THF [% by weight] | Hole transferring material | Vr [V] | Vr calculated based on Vr (100) of Comparative Example |
|---|---|---|---|---|---|---|---|---|
| | Example 203 | CG-3 | AC-3 | −0.85 | 1 | HT-15 | −121 | 87.7 |
| | Example 204 | CG-4 | AC-4 | −1.28 | 3 | HT-15 | −131 | 94.9 |
| | Comp. Example 56 | CG-9 | No addition | — | — | HT-15 | −138 | 100.0 |

TABLE 6

| | | Electric charge generating material | Organic acceptor | Redox potential | Solubility/THF [% by weight] | Hole transferring material | Vr [V] |
|---|---|---|---|---|---|---|---|
| Multi-layer type photosensitive material | Example 145 | CG-1 | AC-1 | −0.95 | 3 | HT-1 | −128 |
| | Comp. Example 57 | CG-5 | AC-5 | −1.53 | 5 | HT-1 | −160 |
| | Comp. Example 58 | CG-6 | AC-6 | −1.32 | 20 | HT-1 | −157 |
| | Comp. Example 59 | CG-7 | AC-7 | −0.37 | 3 | HT-1 | −220 |
| | Comp. Example 60 | CG-8 | AC-8 | −1.31 | 11 | HT-1 | −160 |
| | Comp. Example 61 | CG-9 | AC-1 | −0.95 | 3 | HT-1 | −149 |

In Comparative Example 61, AC-1 was simply added and poor dispersion of the electric charge generating material occurred.

As is apparent from the drawings and tables, a photosensitive material comprising, as the electric charge generating material, a phthalocyanine crystal produced by adding an organic acceptor compound, wherein a reduction potential to a reference electrode ($Ag^+/Ag$) is not less than −1.5 V and not more than −0.5 V and a solubility of the organic acceptor compound in a solvent in a coating solution for photosensitive layer is less than 10% by weight, during a step of converting into a pigment exhibits higher sensitivity than that of the photosensitive material containing a phthalocyanine crystal produced by adding no organic acceptor compound in both cases of the single-layer photosensitive material and multi-layer photosensitive material.

When the organic acceptor compound is simply adding in the coating solution for photosensitive layer or the coating solution for electric charge generating layer, crystallization of the photosensitive layer and poor dispersion of the electric charge generating material are liable to occur and, furthermore, the sensitivity also became poor (Comparative Example 41 in Table 4 and Comparative Example 61 in Table 6).

The disclosure of Japanese Patent Application Serial No.11-213814, filed on Jul. 28, 1999, is incorporated herein by reference.

What is claimed is:

1. A phthalocyanine crystal in which an organic acceptor compound whose reduction potential to a reference electrode ($Ag^+/Ag$) is not less than −1.5 V and not more than −0.5 V is associated with a phthalocyanine molecule wherein said organic acceptor compound contains a compound selected from a group represented by the following general formulas:

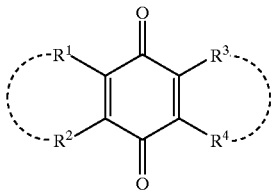

wherein $R^1$, $R^2$, $R^3$ and $R^4$ are the same or different and each represents a hydrogen atom, a halogen atom, or an alkyl, alkyl halide, alkoxy, aryl, aralkyl, cycloalkyl, cyano, nitro or amino group which may have a substituent, with a proviso that $R^1$ and $R^2$, or $R^3$ and $R^4$ may be combined with each other to form a ring;

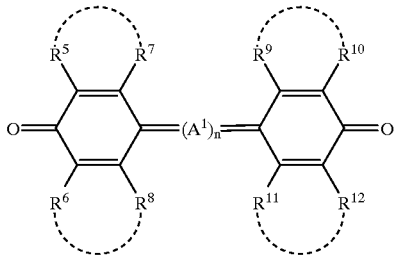

wherein $R^5$, $R^6$, $R^7$, $R^8$, $R^9$, $R^{10}$, $R^{11}$, and $R^{12}$ are the same or different and each represents a hydrogen atom, a halogen atom, or an alkyl, alkyl halide, alkoxy, aryl, aralkyl, cycloalkyl, cyano, nitro or amino group which may have a substituent, with a proviso that $R^5$ and $R^7$, $R^6$ and $R^8$, $R^9$ and $R^{10}$, or $R^{11}$ and $R^{12}$ may be combined with each other to form a ring; and $A^1$ represents a saturated or unsaturated alkyl group which may have a substituent, an aryl group, or a heterocycle which may have a substituent;

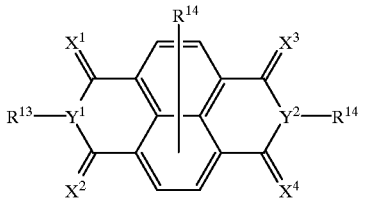

wherein $X^1$, $X^2$, $X^3$ and $X^4$ are the same or different and each represents an oxygen atom or $C(CN)_2$; $R^{13}$ and $R^{14}$ are the same or different and each represents a hydrogen atom, a halogen atom, or an alkyl, alkyl halide, alkoxy, aryl, aralkyl, cycloalkyl, cyano, nitro or amino group which may have a substituent; and $Y^1$ and $Y^2$ are the same or different and each represents a carbon atom, an oxygen atom, or a nitrogen atom; and

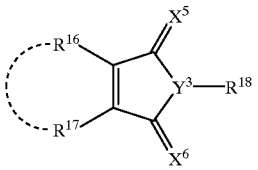

wherein $X^5$ and $X^6$ are the same or different and each represents an oxygen atom or $C(CN)_2$; and $R^{16}$, $R^{17}$, and $R^{18}$ are the same or different and each represents a hydrogen atom, a halogen atom, or an alkyl, alkyl halide, alkoxy, aryl, aralkyl, cycloalkyl, cyano, nitro or amino group which may have a substituent, with a proviso that $R^{16}$ and $R^{17}$ may be combined with each other to form a ring.

2. The phthalocyanine crystal according to claim 1, wherein said phthalocyanine is a metal-free phthalocyanine.

3. The phthalocyanine crystal according to claim 1, wherein said phthalocyanine is a metal phthalocyanine represented by the general formula:

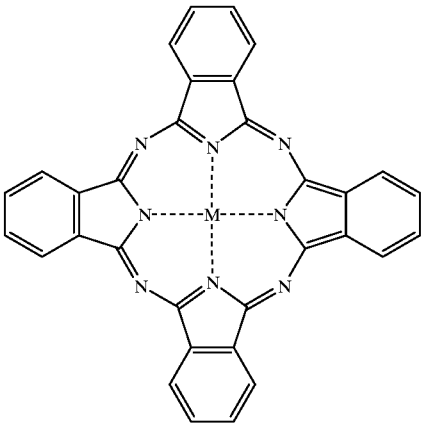

wherein M is a metal of the groups IIa, IIIa, IVa, Va VII, Ib, IIb, IIIb, IVb or VIb on the periodic table or a group containing the metal.

4. The phthalocyanine crystal according to claim 3, wherein the group containing the metal is in the form of oxide, hydroxide, halide or cyanide.

5. The phthalocyanine crystal according to claim 3, wherein M is TiO.

6. The phthalocyanine crystal according to claim 1, wherein a solubility of said organic acceptor compound in a solvent in a coating solution for photosensitive layer is less than 10% by weight, said solvent is one or more member selected from the group consisting of alcohols, ketones, and ethers.

7. The phthalocyanine crystal according to claim 1 in which an organic acceptor compound is associated with a phthalocyanine molecule, which is produced by adding the organic acceptor compound whose reduction potential to a reference electrode ($Ag^+/Ag$) is not less than −1.5 V and not more than −0.5 V during a step of converting into a pigment.

8. An electrophotosensitive material comprising a conductive substrate and a photosensitive layer provided on the conductive substrate, wherein the photosensitive layer contains the phthalocyanine crystal of claim 7 as an electric charge generating material.

9. The electrophotosensitive material according to claim 8, which is a single-layer photosensitive material, comprising said phthalocyanine crystal and at least one of a hole transferring material and an electron transferring material dispersed into a binder resin.

10. The electrophotosensitive material according to claim 8, wherein said photosensitive layer is a laminated photosensitive layer which comprises an electric charge generating layer containing said phthalocyanine crystal and an electron transferring layer containing at least one of a hole transferring material and an electron transferring material.

11. A method of producing the phthalocyanine crystal of claim 1 in which an organic acceptor compound is associated with a phthalocyanine molecule, a step of which comprises: dissolving said phthalocyanine together with said organic acceptor compound whose reduction potential to a reference electrode ($Ag^+/Ag$) is not less than −1.5 V and not more than −0.5V in a solvent capable of dissolving both of said phthalocyanine and said organic acceptor compound, adding the resulting solution to an aqueous methanol, thereby crystallizing said phthalocyanine associated with said organic acceptor compound.

12. An electrophotosensitive material comprising a conductive substrate and a photosensitive layer provided on the conductive substrate, wherein the photosensitive layer contains the phthalocyanine crystal of claim 1 as an electric charge generating material.

13. The electrophotosensitive material according to claim 12, which is a single-layer photosensitive material comprising said phthalocyanine crystal and at least one of a hole transferring material and an electron transferring material dispersed into a binder resin.

14. The electrophotosensitive material according to claim 13, wherein said single photosensitive layer contains both of the hole transferring material and the electron transferring material.

15. The electrophotosensitive material according to claim 13, wherein said single photosensitive layer is formed by coating a coating solution which comprises adding said phthalocyanine crystal, at least one of the hole transferring material and the electron transferring material, and the binding resin to an organic solvent, and then drying the coated layer.

16. The electrophotosensitive material according to claim 13, wherein said binder resin containing a bisphenol z polycarbonate resin.

17. The electrophotosensitive material according to claim 12, wherein said photosensitive layer is a laminated photosensitive layer which comprises an electric charge generating layer containing said phthalocyanine crystal and an electron transferring layer containing at least one of a hole transferring material and an electron transferring material.

18. The electrophotosensitive material according to claim 17, wherein said electric charge generating layer is formed by coating a coating solution which comprises adding said phthalocyanine crystal and a binding resin to an organic solvent, and then drying the coated layer.

19. The electrophotosensitive material according to claim 17, wherein said photosensitive layer further comprises a binder resin contains a bisphenol z polycarbonate resin.

20. The phthalocyanine crystal according to claim 6, wherein the solvent is selected from the group consisting of methanol, ethanol, isopropanol, butanol, dimethyl ether, diethyl ether, tetrahydrofuran, ethylene glycol dimethyl ether, diethylene glycol dimethyl ether, acetone, methyl ethyl ketone, and cyclohexane.

21. A phthalocyanine crystal in which an organic acceptor compound whose reduction potential to a reference electrode ($Ag^+/Ag$) is not less than −1.5 V and not more than −0.5 V is associated with a phthalocyanine molecule, wherein said organic acceptor compound contains a compound represented by the general formula:

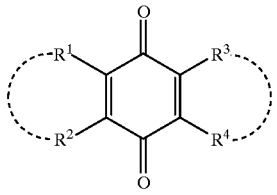

wherein $R^1$, $R^2$, $R^3$ and $R^4$ are the same or different and each represents a hydrogen atom, a halogen atom, or an alkyl, alkyl halide, alkoxy, aryl, aralkyl, cycloalkyl, cyano, nitro or amino group which may have a substituent, with a proviso that $R^1$ and $R^2$, or $R^3$ and $R^4$ may be combined with each other to form a ring.

22. A phthalocyanine crystal in which an organic acceptor compound whose reduction potential to a reference electrode ($Ag^+/Ag$) is not less than −1.5 V and not more than −0.5 V is associated with a phthalocyanine molecule wherein said organic acceptor compound contains a compound represented by the general formula:

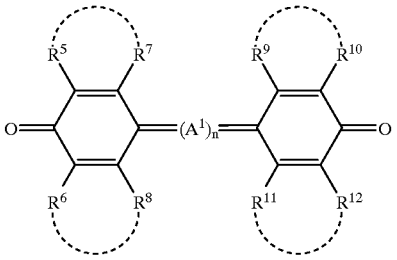

wherein $R^5$, $R^6$, $R^7$, $R^8$, $R^9$, $R^{10}$, $R^{11}$, and $R^{12}$ are the same or different and each represents a hydrogen atom, a halogen atom, or an alkyl, alkyl halide, alkoxy, aryl, aralkyl, cycloalkyl, cyano, nitro or amino group which may have a substituent, with a proviso that $R^5$ and $R^7$, $R^6$ and $R^8$, $R^9$ and $R^{10}$, or $R^{11}$ and $R^{12}$ may be combined with each other to form a ring; and $A^1$ represents a saturated or unsaturated alkyl group which may have a substituent, an aryl group, or a heterocycle which may have a substituent.

23. A phthalocyanine crystal in which an organic acceptor compound whose reduction potential to a reference electrode ($Ag^+/Ag$) is not less than −1.5 V and not more than −0.5 V is associated with a phthalocyanine molecule, wherein said organic acceptor compound contains a compound represented by the general formula:

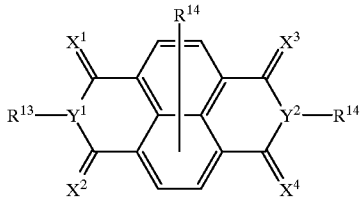

wherein $X^1$, $X^2$, $X^3$ and $X^4$ are the same or different and each represents an oxygen atom or $C(CN)_2$; $R^{13}$ and $R^{14}$ are the same or different and each represents a hydrogen atom, a halogen atom, or an alkyl, alkyl halide, alkoxy, aryl, aralkyl, cycloalkyl, cyano, nitro or amino group which may have a substituent; and $Y^1$ and $Y^2$ are the same or different and each represents a carbon atom, an oxygen atom, or a nitrogen atom.

24. A phthalocyanine crystal in which an organic acceptor compound whose reduction potential to a reference electrode ($Ag^+/Ag$) is not less than −1.5 V and not more than −0.5 V is associated with a phthalocyanine molecule wherein said organic acceptor compound contains a compound represented by the general formula:

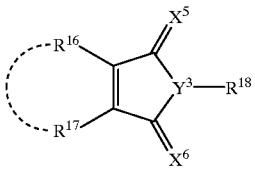

wherein $X^5$ and $X^6$ are the same or different and each represents an oxygen atom or $C(CN)_2$; and $R^{16}$, $R^{17}$, and $R^{18}$ are the same or different and each represents a hydrogen atom, a halogen atom, or an alkyl, alkyl halide, alkoxy, aryl, aralkyl, cycloalkyl, cyano, nitro or amino group which may have a substituent, with a proviso that $R^{16}$ and $R^{17}$ may be combined with each other to form a ring.

* * * * *